US009777928B2

(12) United States Patent
Boedicker et al.

(10) Patent No.: US 9,777,928 B2
(45) Date of Patent: Oct. 3, 2017

(54) DOUBLE OVEN CYCLE SYNC

(71) Applicant: General Electric Company, Schenectady, NY (US)

(72) Inventors: Stephen Christopher Boedicker, Louisville, KY (US); Sabrina Marie Hannah, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 68 days.

(21) Appl. No.: 14/702,937

(22) Filed: May 4, 2015

(65) Prior Publication Data

US 2016/0324360 A1 Nov. 10, 2016

(51) Int. Cl.
*A47J 27/08* (2006.01)
*F24C 7/08* (2006.01)

(52) U.S. Cl.
CPC ..... *F24C 7/088* (2013.01)

(58) Field of Classification Search
CPC ... A47J 27/62; A47J 36/32; F24C 7/07; F24C 7/087; F24C 7/088
USPC ..... 99/325–329 R, 331
See application file for complete search history.

(56) References Cited

U.S. PATENT DOCUMENTS

| | | | | |
|---|---|---|---|---|
| 6,831,254 | B2 | 12/2004 | Barritt | |
| 2004/0020917 | A1* | 2/2004 | Sauter | F24C 7/087 219/490 |
| 2005/0274711 | A1* | 12/2005 | Boyer | F24C 7/087 219/494 |
| 2008/0121635 | A1* | 5/2008 | Lee | H05B 6/6473 219/681 |
| 2009/0065493 | A1* | 3/2009 | Hines, Jr. | F24C 15/325 219/400 |

* cited by examiner

*Primary Examiner* — Quang D Thanh
*Assistant Examiner* — Brandon Harvey
(74) *Attorney, Agent, or Firm* — Dority & Manning, P.A.

(57) ABSTRACT

An oven appliance having at least two cooking chambers with features for ensuring the cooking chambers exit preheat and finish cooking food items within each cooking chamber at the same time is provided. A method for operating an oven appliance having at least two cooking chambers also is provided. The method includes features for ensuring the cooking chambers exit preheat and finish cooking food items within each cooking chamber at the same time.

20 Claims, 6 Drawing Sheets

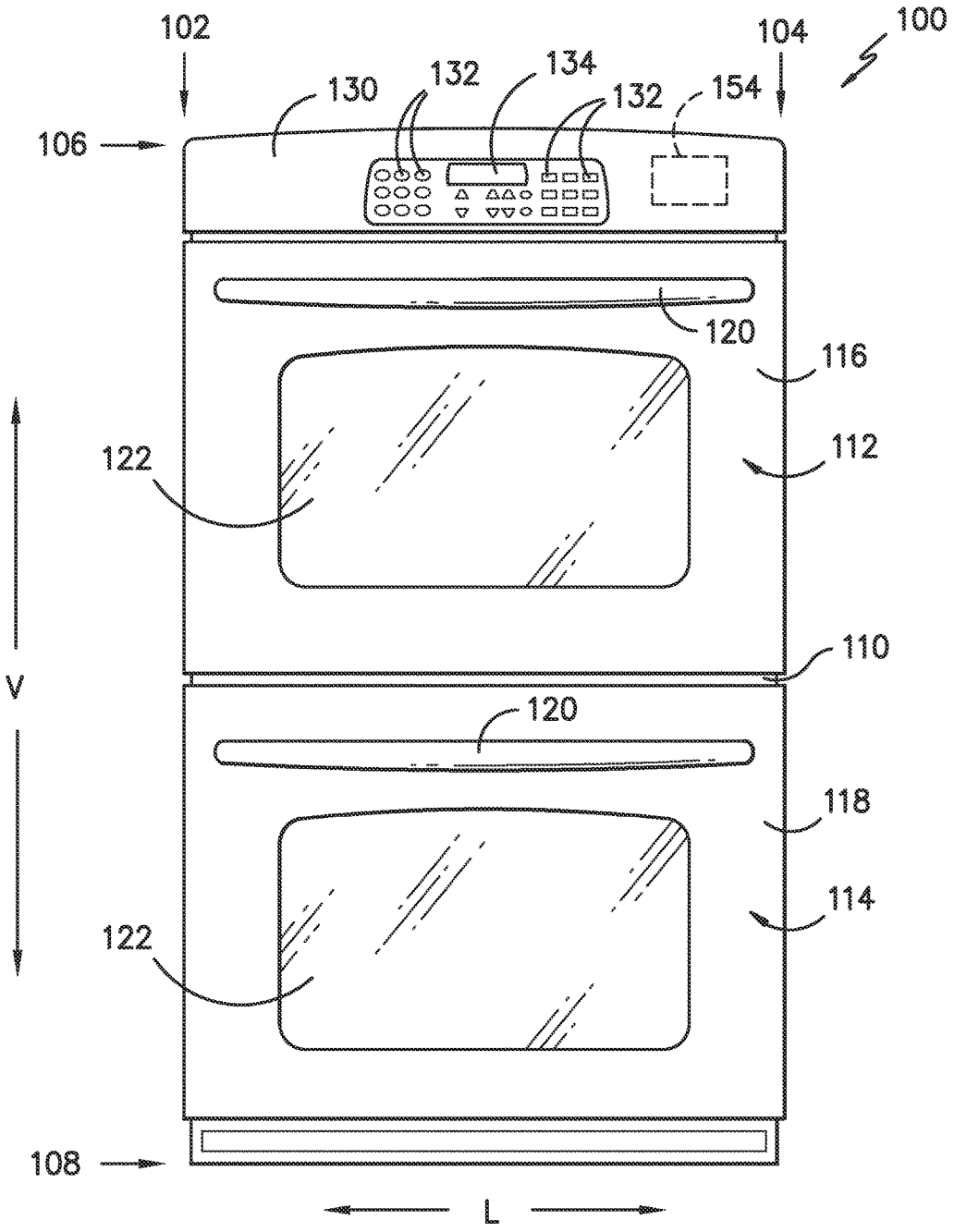
- FIG. 1 -

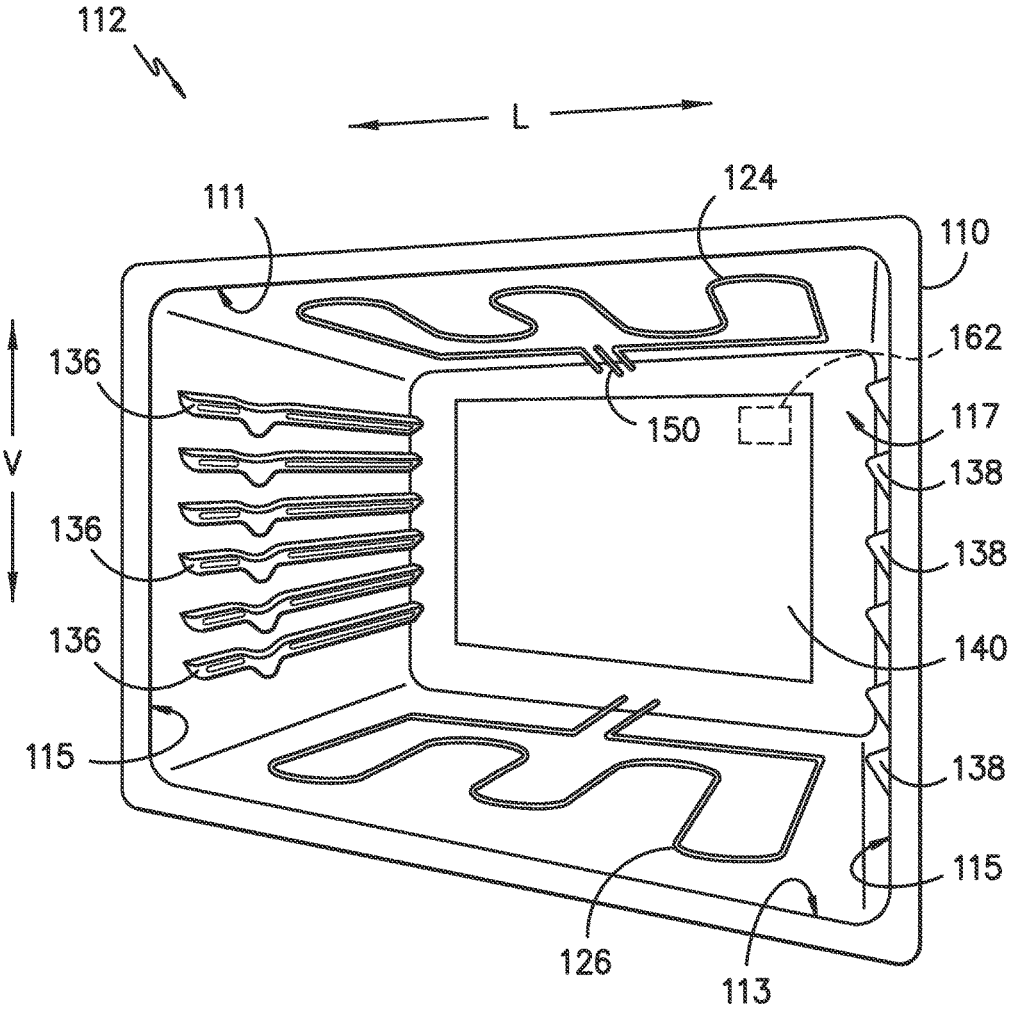
- FIG. 2 -

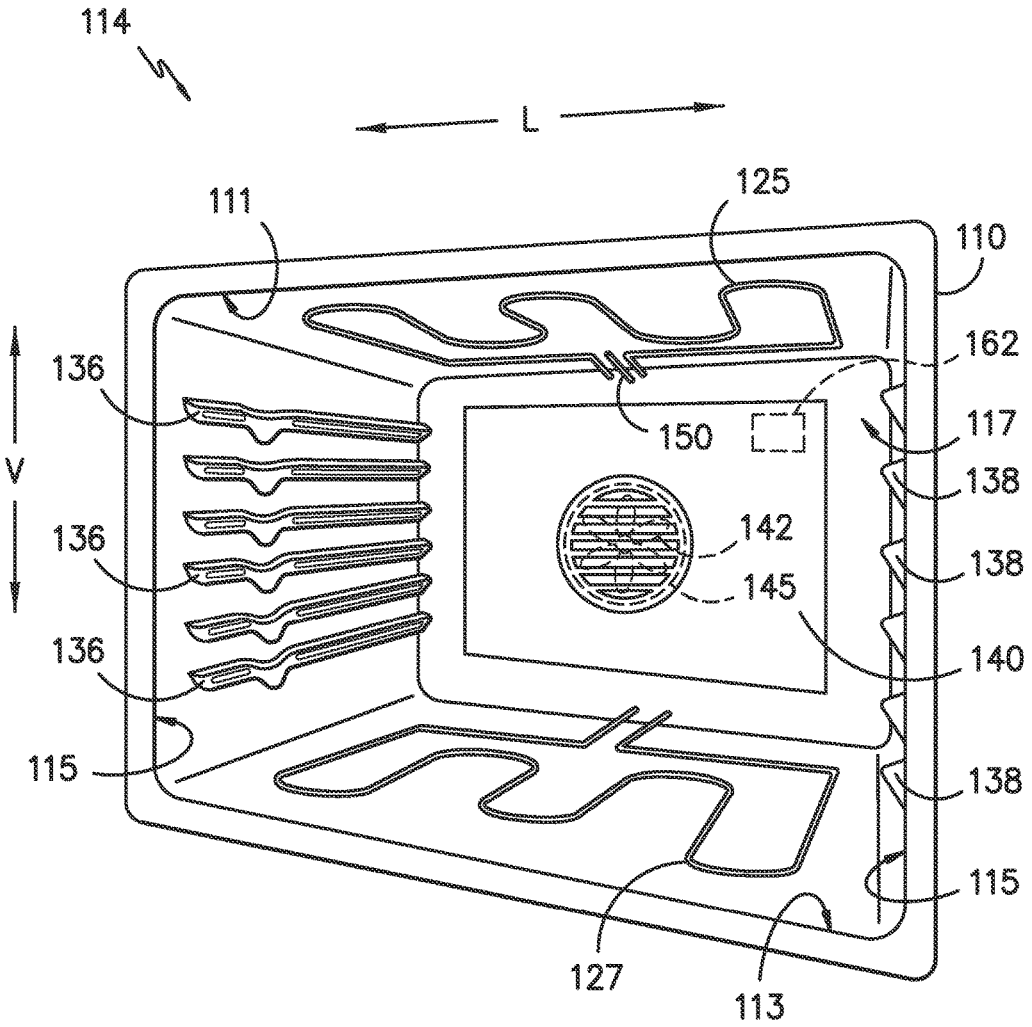
- FIG. 3 -

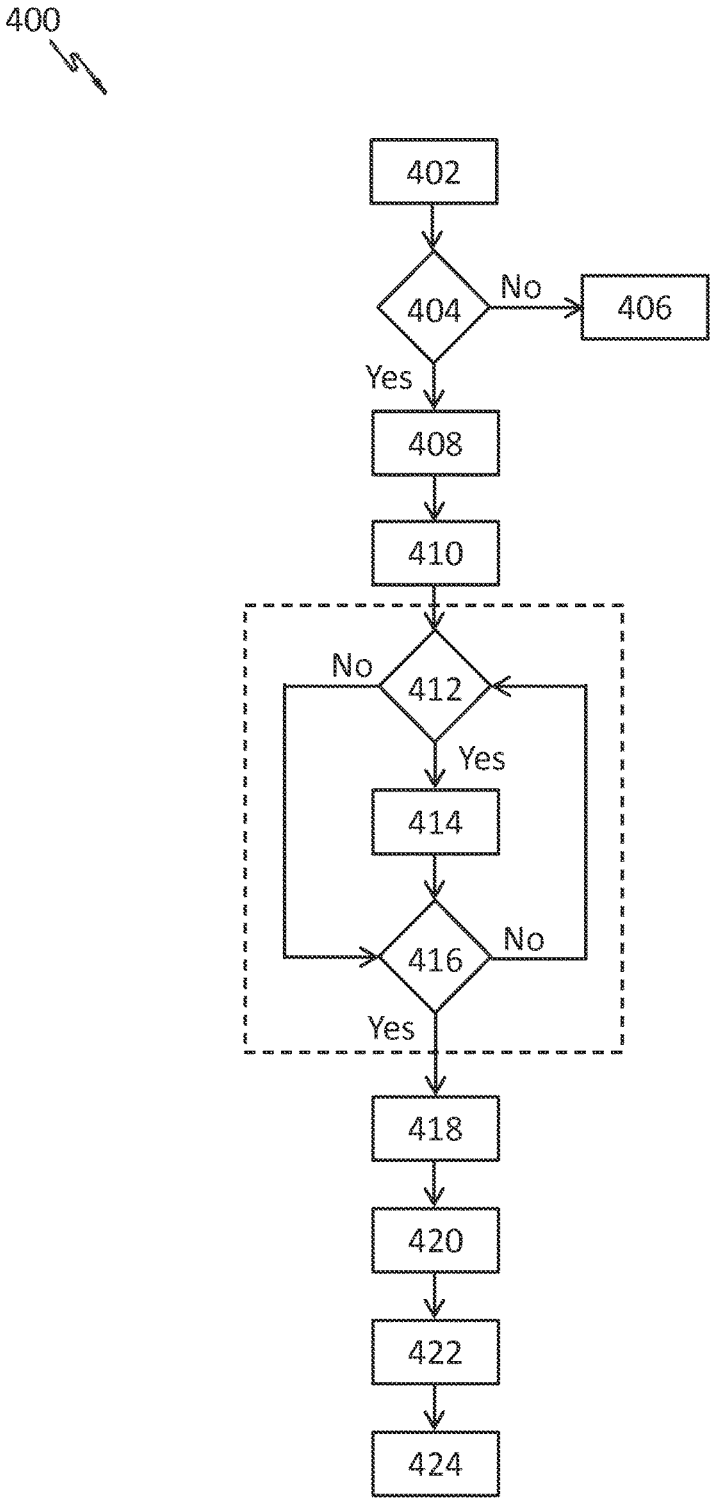
- FIG. 4 -

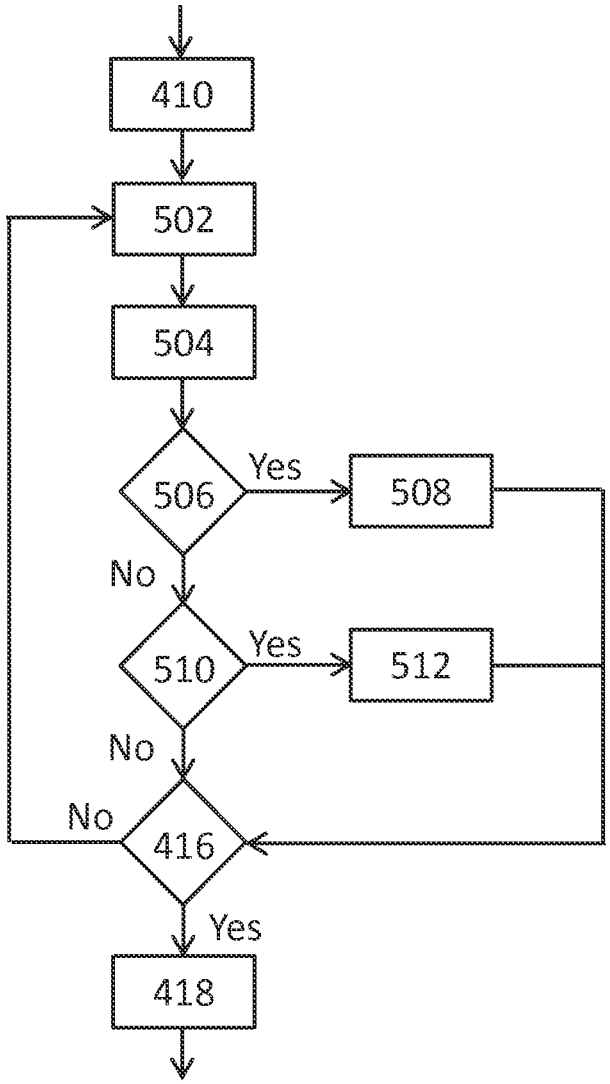
- FIG. 5 -

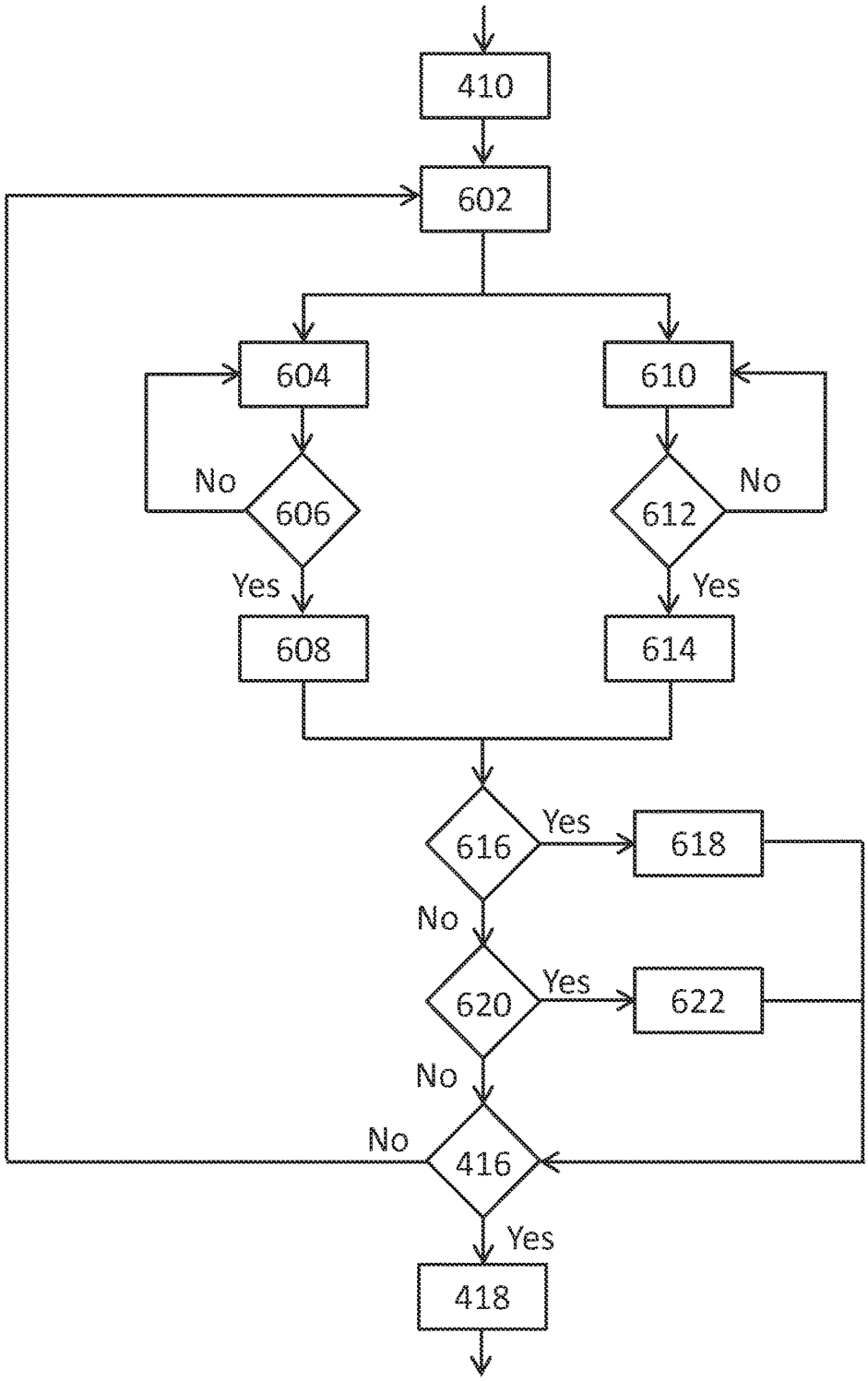
- FIG. 6 -

DOUBLE OVEN CYCLE SYNC

FIELD OF THE INVENTION

The subject matter of the present disclosure relates generally to an oven appliance and methods for operating an oven appliance.

BACKGROUND OF THE INVENTION

Oven appliances generally include a cabinet that defines one or more cooking chambers for baking or broiling food items therein. To heat the cooking chambers for baking or other oven operations, oven appliances include one or more heating elements positioned at a top portion, bottom portion, or both of the cooking chambers. Some oven appliances also include a convection heating element and fan for convection cooking cycles. The heating element or elements may be used for various cycles of the oven appliance, such as a preheat cycle, a cooking cycle, or a self-cleaning cycle.

Typically, oven appliances including two cooking chambers (often referred to as double oven appliances) have cooking chambers of different sizes, i.e., one chamber generally has a larger volume than the other chamber. Also, the number, configuration, and power rating of the heating elements typically varies between the cooking chambers of a double oven, e.g., one chamber may have a bake heating element and a broil heating element and the other chamber may have a bake heating element, a broil heating element, and a convection heating element, as well as a convection fan.

From time to time, or even often, a user of an oven appliance may desire to cook a large quantity or several pans or dishes of a food item and, thus, may desire to use both cooking chambers of a double oven to cook the same food item. However, because of the differences in size and heating rates between the chambers, the time required to preheat the cooking chamber is likely different for each cooking chamber, and the time required to cook the food item likely varies between the cooking chambers. Therefore, the user may be uncertain as to when each cooking chamber will be preheated and when the food item in each chamber will be cooked, and the user could be dissatisfied with the variations in preheat and cooking time between the cooking chambers.

Accordingly, an oven appliance with features for ensuring the cooking chambers of an oven appliance having at least two cooking chambers exit preheat and finish cooking food items within each cooking chamber at the same time also would be advantageous. Further, a method for operating an oven appliance to ensure the cooking chambers of an oven appliance having at least two cooking chambers exit preheat and finish cooking food items within each cooking chamber at the same time would be beneficial.

BRIEF DESCRIPTION OF THE INVENTION

The present invention provides an oven appliance having at least two cooking chambers with features for ensuring the cooking chambers exit preheat and finish cooking food items within each cooking chamber at the same time. A method for operating an oven appliance having at least two cooking chambers also is provided. The method includes features for ensuring the cooking chambers exit preheat and finish cooking food items within each cooking chamber at the same time. Additional aspects and advantages of the invention will be set forth in part in the following description, may be apparent from the description, or may be learned through practice of the invention.

In a first exemplary embodiment, a method for operating an oven appliance is provided. The oven appliance includes an upper cooking chamber and a lower cooking chamber each configured for receipt of food items for cooking. The method includes ascertaining whether a sync mode of the oven appliance has been selected and, if so, then determining a preheat exit temperature $T_{pre1}$ for the upper cooking chamber and a preheat exit temperature $T_{pre2}$ for the lower cooking chamber; initiating a preheat cycle for each cooking chamber; determining whether the upper or lower cooking chamber is heating faster than the other cooking chamber and, if so, then adjusting the preheat cycle of the cooking chamber that is heating faster; and determining whether the temperature within the upper cooking chamber has reached at least preheat exit temperature $T_{pre1}$ and the temperature within the lower cooking chamber has reached at least preheat exit temperature $T_{pre2}$ and, if so, then initiating a sync cooking cycle for each cooking chamber.

In a second exemplary embodiment, an oven appliance is provided. The oven appliance includes a cabinet defining an upper cooking chamber and a lower cooking chamber, each of the upper and lower cooking chamber configured for receipt of food items for cooking; a plurality of upper heating elements, the upper heating elements configured to heat the upper cooking chamber; a plurality of lower heating elements, the lower heating elements configured to heat the lower cooking chamber; and a controller in operative communication with the upper and lower heating elements. The controller is configured for ascertaining whether a sync mode of the oven appliance has been selected and, if so, then determining a preheat exit temperature $T_{pre1}$ for the upper cooking chamber and a preheat exit temperature $T_{pre2}$ for the lower cooking chamber; initiating a preheat cycle for each cooking chamber; determining whether the upper or lower cooking chamber is heating faster than the other cooking chamber and, if so, then adjusting the preheat cycle of the cooking chamber that is heating faster; and determining whether the temperature within the upper cooking chamber has reached at least preheat exit temperature $T_{pre1}$ and the temperature within the lower cooking chamber has reached at least preheat exit temperature $T_{pre2}$ and, if so, then initiating a sync cooking cycle for each cooking chamber.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 provides a front, elevation view of an oven appliance having an upper and a lower cooking chamber according to an exemplary embodiment of the present subject matter.

FIG. 2 provides a perspective view of an exemplary embodiment of the upper cooking chamber of the oven appliance of FIG. 1.

FIG. 3 provides a perspective view of an exemplary embodiment of the lower cooking chamber of the oven appliance of FIG. 1.

FIG. 4 provides a chart illustrating a method of operating an oven appliance in accordance with one exemplary embodiment of the present subject matter.

FIG. 5 provides a chart illustrating a portion of the method of operating an oven appliance of FIG. 4 in accordance with one exemplary embodiment of the present subject matter.

FIG. 6 provides a chart illustrating a portion of the method of operating an oven appliance of FIG. 4 in accordance with another exemplary embodiment of the present subject matter.

Use of the same reference numerals in different figures denotes the same or similar features.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, elevation view of an oven appliance 100 according to an exemplary embodiment of the present subject matter. Oven appliance 100 defines a vertical direction V, a lateral direction L and a transverse direction T (not shown). The vertical direction V, lateral direction L and transverse direction T are mutually perpendicular and form an orthogonal direction system. Oven appliance 100 includes an insulated oven body 110 that extends between a first side portion 102 and a second side portion 104, e.g., along a lateral direction L. Body 110 also extends between a top portion 106 and a bottom portion 108, e.g., along the vertical direction V.

Body 110 defines an upper cooking chamber 112 and a lower cooking chamber 114. Upper cooking chamber 112 is positioned at or adjacent top portion 106 of body 110. Lower cooking chamber 114 is positioned at or adjacent bottom portion 108 of body 110. Oven appliance 100 is generally referred to as a double wall oven appliance. As will be understood by those skilled in the art, oven appliance 100 is provided by way of example only, and the present subject matter may be used in any suitable oven appliance, e.g., a double oven range appliance. Thus, the exemplary embodiment shown in FIG. 1 is not intended to limit the present subject matter in any aspect.

Upper and lower cooking chambers 112 and 114 are configured for the receipt of one or more food items to be cooked. Oven appliance 100 includes an upper door 116 and a lower door 118 pivotally attached to body 110 to permit selective access to upper cooking chamber 112 and lower cooking chamber 114, respectively. Handles 120 are mounted to upper and lower doors 116 and 118 to assist a user with opening and closing doors 116 and 118 to access cooking chambers 112 and 114. As an example, a user can pull on handle 120 mounted to upper door 116 to open or close upper door 116 and access upper cooking chamber 112. Glass window panes 122 provide for viewing the contents of upper and lower cooking chambers 112 and 114 when doors 116 and 118 are closed and also assist with insulating upper and lower cooking chambers 112 and 114. Oven appliance 100 can include a seal (not shown) between doors 116, 118 and cabinet 110 that assists with maintaining heat and cooking fumes within cooking chambers 112, 114 when doors 116, 118 are closed as shown in FIG. 1.

Referring to FIG. 2, for this exemplary embodiment, upper cooking chamber 112 is defined by a top wall 111, a bottom wall 113, opposing side walls 115, and a back wall 117. A baking rack (not shown) for the receipt of food items or utensils containing food items may be slidably received onto embossed ribs or sliding rails 136, 138 such that the rack may be conveniently moved into and out of upper cooking chamber 112 when door 116 is open. A plurality of upper heating elements, including a heating element at the top, bottom, or both of upper cooking chamber 112, provides heat from an energy source or power supply 162 to cooking chamber 112 for cooking. Such heating element(s) can be, e.g., gas, electric, microwave, or a combination thereof. For example, in the embodiment shown in FIG. 2, upper cooking chamber 112 includes an upper broil heating element 124 and an upper bake heating element 126, which are connected to power supply 162.

In some embodiments, the plurality of upper heating elements may also include an upper convection heating element (not shown), which is positioned with an upper convection fan (not shown) behind a protective panel adjacent back wall 117. In such embodiments, the upper convection fan may provide air movement in upper cooking chamber 112 during, e.g., convection modes of oven appliance 100.

Further, a temperature sensor 150 may be located adjacent top wall 111. In alternative embodiments, temperature sensor 150 may be positioned in another location within upper cooking chamber 112. In still other embodiments, oven appliance 100 may include more than one temperature sensor within upper cooking chamber 112. Temperature sensor 150 may be a resistive temperature device (RTD) or any other suitable sensor.

As shown in FIG. 3, lower cooking chamber 114 may be configured similarly to upper cooking chamber 112. Accordingly, lower cooking chamber 114 may be defined by a top wall 111, a bottom wall 113, opposing side walls 115, and a back wall 117. A baking rack (not shown) for the receipt of food items or utensils containing food items may be slidably received onto embossed ribs or sliding rails 136, 138 such that the rack may be conveniently moved into and out of lower cooking chamber 114 when door 118 is open. In the embodiment shown in FIG. 2, lower cooking chamber 114 has a plurality of lower heating elements, including a lower broil heating element 125, a lower bake heating element 127, and a lower convection heating element 145, which are connected to power supply 162. Heating elements 125, 127, 129 can be, e.g., gas, electric, or microwave heating elements, or a combination thereof.

Lower cooking chamber 114 also includes a lower convection fan 142, which is positioned with lower convection heating element 145 behind a protective panel 140 adjacent back wall 117. Fan 142 may provide air movement in lower cooking chamber 114 during, e.g., convection modes of oven appliance 100. Other configurations of lower convection fan 142 and lower convection heating element 145 may be used as well.

Further, a temperature sensor 150 may be located adjacent top wall 111. In alternative embodiments, temperature sensor 150 may be positioned in another location within lower cooking chamber 114. In still other embodiments, oven appliance 100 may include more than one temperature sensor within lower cooking chamber 114. Temperature sensor 150 may be a resistive temperature device (RTD) or any other suitable sensor.

In some embodiments of oven appliance 100, upper cooking chamber 112 and lower cooking chamber 114 may be identically configured, i.e., each cooking chamber may be the same size or same heated volume and may include the same number, type, and size of heating elements, i.e., heating elements of the same power rating may be positioned at the same location within each cooking chamber 112, 114. In other embodiments, upper cooking chamber 112 may be configured differently than lower cooking chamber 114, e.g., upper cooking chamber 112 may be a different size (i.e., a different heated volume) than lower cooking chamber 114 and/or upper cooking chamber 112 may include a different number, type, and size of heating elements. For example, upper cooking chamber 112 may be smaller than lower cooking chamber 114 and upper cooking chamber 112 may include a bake heating element 126 and a broil heating element 124 while lower cooking chamber 114 includes bake heating element 127, broil heating element 125, and convection heating element 145, along with fan 142. Additionally, the heating elements of upper cooking chamber 112 may have a lower power rating (i.e., may be smaller than) the heating elements of lower cooking chamber 114, e.g., bake heating element 126 may have a lower power rating than bake heating element 127 and/or broil heating element 124 may have a lower power rating than broil heating element 125. Upper cooking chamber 112 and lower cooking chamber 114 may have other configurations as well.

Referring back to FIG. 1, oven appliance 100 includes a control panel 130 having a display 134 and a variety of controls 132. Using controls 132, a user of oven appliance 100 may select various options for the operation of oven 100 including, e.g., temperature, time, and/or various cooking and cleaning cycles of cooking chambers 112, 114. Information as to, e.g., the operation of oven 100 may be shown on display 134, which can be a liquid crystal display, a dot matrix display, a series of seven-segment displays, etc.

Operation of oven appliance 100 can be regulated by a controller 154 that is operatively coupled, i.e., in communication with, control panel 130, upper heating elements 124, 126, lower heating elements 125, 127, 145, fan 142, and/or other components of oven 100. For example, in response to user manipulation of the control panel 130, controller 154 can operate one or more heating elements of upper cooking chamber 112 and/or lower cooking chamber 114. As a further example, controller 154 can receive measurements from temperature sensor 150 of upper cooking chamber 112 and/or lower cooking chamber 114 and, e.g., provide a temperature indication to the user with display 134. Controller 154 can also be provided with other features as will be further described herein.

Controller 154 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor.

Controller 154 may be positioned in a variety of locations throughout oven appliance 100. In the illustrated embodiment, controller 154 is located within control panel 130. In other embodiments, controller 154 may be located at any other appropriate location with respect to oven appliance 100. In the embodiment shown in FIG. 1, input/output ("I/O") signals are routed between controller 154 and various operational components of oven appliance 100 such as upper heating elements 124, 126, lower heating elements 125, 127, 145, fan 142, controls 132, display 134, temperature sensors 150, alarms, and/or other components as may be provided. In one embodiment, the control panel 130 may represent a general purpose I/O ("GPIO") device or functional block.

Although shown with touch type controls 132, it should be understood that controls 132 and the configuration of oven appliance 100 shown in FIG. 1 is provided by way of example only. More specifically, control panel 130 may include various input components, such as one or more of a variety of electrical, mechanical, or electro-mechanical input devices including rotary dials, push buttons, and touch pads. Panel 130 may include other display components, such as a digital or analog display device designed to provide operational feedback to a user. Panel 130 may be in communication with controller 154 via one or more signal lines or shared communication busses.

In one exemplary embodiment, controller 154 may be in operative communication with various components of oven appliance 100. As previously described, controller 154 is in communication with controls 132, upper heating elements 124, 126, and lower heating elements 125, 127, 145. Thus, by manipulating controls 132, a user can select, e.g., a cooking mode of upper cooking chamber 112 and/or lower cooking chamber 114, a cooking temperature of upper cooking chamber 112 and/or lower cooking chamber 114, or a cleaning cycle of upper cooking chamber 112 and/or lower cooking chamber 114. The selection of a cooking mode, such as, e.g., bake, broil, or convect, and a cooking temperature for one of cooking chambers 112, 114 by the user may initiate a preheat cycle of the cooking chamber. During a preheat cycle, the air and surfaces of the cooking chamber are brought up to temperature for a cooking cycle at the selected temperature in the selected cooking mode.

At times, a user may desire to use both upper and lower cooking chambers 112, 114 to cook the same type of food item, and in such instances, the user may desire that that the food items in each cooking chamber begin and finish cooking at approximately the same time. That is, the user may desire that each cooking chamber 112, 114 exit its preheat cycle at the same time and finish cooking the food item or items in each cooking chamber 112, 114 at the same time. However, as described, upper cooking chamber 112 may have a different configuration from lower cooking chamber 114. In such embodiments, even if the user selected the same cooking temperature for each cooking chamber, cooking chambers 112, 114 would not preheat within the same amount of time, and food items placed in one cooking chamber would finish cooking at a different time from food items placed in the other cooking chamber.

Thus, to use both cooking chambers 112, 114 to cook food items within the same amount of time, a synchronization or sync mode may be provided. If the user selects the sync mode and a cooking temperature, a sync preheat cycle and sync cooking cycle are executed for each cooking chamber. During the sync preheat cycle, a suitable device, such as, e.g., controller 154, monitors the temperature of each cooking chamber 112, 114 and adjusts the preheat cycle of one or both cooking chambers as needed such that each cooking chamber finishes preheating at the same time. Then, based on the user selected cooking temperature, controller 154 selects a sync cooking cycle for each cooking chamber 112, 114 such that food items placed in each cooking chamber finish cooking at approximately the same time. If the user does not choose the sync mode, a normal preheat algorithm and a normal cooking algorithm may be executed for each cooking chamber, i.e., each cooking chamber is preheated and executes a cooking cycle without reference to the other cooking chamber.

FIG. 4 provides a chart illustrating an exemplary method 400 of operating oven appliance 100. Although described below as performed by controller 154, method 400 may be performed in whole or in part by controller 154 or any other suitable device or devices. At step 402, controller 154 detects inputs by a user of oven appliance 100, such as, e.g., a cook mode and cooking temperature for one or more cooking chambers of oven appliance 100. At step 404, controller 154 ascertains whether a sync mode of oven appliance 100 has been selected. For example, one of the plurality of controls 132 on control panel 130 may be, e.g., a button, knob, or the like labeled "Sync Mode" or another label indicating to the user that, when selected, the cooking chambers of oven appliance 100 will operate in a synchronization mode. When manipulated, the "Sync Mode" control 132 signals to controller 154 that the user desires to sync the operation of multiple cooking chambers of oven appliance 100, i.e., that the user desires more than one cooking chamber to exit preheat and finish cooking food items within about the same time. Other ways of choosing a sync mode and determining whether a sync mode has been chosen may be used as well.

If controller 154 determines the sync mode has not been chosen, at step 406, controller 154 executes normal preheat and cooking algorithms for one or more cooking chambers, i.e., the preheat cycle and then the cooking cycle proceed without any input configured to synchronize the operation of multiple cooking chambers. However, if the sync mode has been chosen, method 400 includes step 408 of determining a preheat exit temperature $T_{pre}$ for each cooking chamber. For example, for oven appliance 100 having upper cooking chamber 112 and lower cooking chamber 114, controller 154 establishes a preheat exit temperature $T_{pre1}$ for upper cooking chamber 112 and a preheat exit temperature $T_{pre2}$ for lower cooking chamber 114. Preheat exit temperatures $T_{pre1}$, $T_{pre2}$ may be determined using the cooking temperature selected by the user of the oven appliance, e.g., preheat exit temperatures $T_{pre1}$, $T_{pre2}$ may be the cooking temperature selected by the user or a temperature over or under the selected cooking temperature. Preheat exit temperatures $T_{pre1}$, $T_{pre2}$ may be different and may depend on the configuration of cooking chambers 112, 114. In alternative embodiments, preheat exit temperatures $T_{pre1}$, $T_{pre2}$ be predetermined may be predetermined temperatures that are used for each sync preheat cycle, regardless of the cooking temperature selected by the user, or may be predetermined temperatures correlated to the selected cook mode, cooking temperature, and/or other selections by the user. Other values of and methods for determining preheat exit temperatures $T_{pre1}$, $T_{pre2}$ may be used as well.

After determining preheat exit temperatures $T_{pre1}$, $T_{pre2}$, at step 410, controller 154 initiates a preheat cycle for each cooking chamber. The preheat cycle for each cooking chamber comprises parameters that specify the heating element or elements used in the cooking chamber, as well as the timing or duty cycle of the element or elements, to preheat the cooking chamber. For example, the preheat cycle for upper cooking chamber 112 may specify that bake heating element 126 is operated on a first duty cycle and broil heating element 124 is operated on a second duty cycle, such that bake element 126 and broil element 124 are not activated for the same amount of time over their respective duty cycles. The preheat cycle for each cooking chamber may specify other parameters as well.

As shown, controller determines at step 412 whether one cooking chamber is heating faster than the other cooking chamber, e.g., whether upper cooking chamber 112 or lower cooking chamber 114 is ramping faster or heating at a faster rate than the other cooking chamber. If so, at step 414 controller 154 adjusts the preheat cycle of the cooking chamber that is heating faster, e.g., by adjusting one or more parameters of the faster heating cooking chamber. As an example, if lower cooking chamber 114 is ramping faster than upper cooking chamber 112, controller 154 may adjust the duty cycle of one or more heating elements 125, 127, 145 of lower cooking chamber 114 and/or may adjust the speed or duty cycle of convection fan 142. In one embodiment, controller 154 may shorten the portion of the duty cycle of bake heating element 127 that bake element 127 is activated or on. In another embodiment, controller 154 may deactivate broil heating element 125 or decrease the portion of the duty cycle of convection heating element 145 that convection element 145 is activated or on. Other ways of adjusting the preheat cycle of the faster heating cooking chamber also may be used.

At step 416, controller 154 determines whether the temperature within each cooking chamber has reached at least its preheat exit temperature $T_{pre}$, e.g., whether the temperature within upper cooking chamber 112 has reached at least preheat exit temperature $T_{pre1}$ and the temperature within lower cooking chamber 114 has reached at least preheat exit temperature $T_{pre2}$. Controller 154 may use, e.g., temperature sensor 150 within each cooking chamber to determine the temperature within the cooking chamber. If the temperature within either chamber has not reached at least its preheat exit temperature $T_{pre}$, method 400 returns to step 412 of determining whether one cooking chamber is heating faster than the other cooking chamber. If the temperature within each cooking chamber has reached at least its preheat exit temperature $T_{pre}$, then each cooking chamber is preheated, e.g., the temperature within upper cooking chamber 112 has reached at least preheat exit temperature $T_{pre1}$ and the temperature within lower cooking chamber 114 has reached at least preheat exit temperature $T_{pre2}$. As a result, at step 418, a sync cooking cycle for each cooking chamber is initiated.

Thus, as described, the preheat cycle of one cooking chamber or of each cooking chamber may be adjusted such that the cooking chambers reach their preheat exit temperatures at substantially the same time. At step 420, a signal may be provided to a user of oven appliance 100 that the preheat cycle of each cavity is complete. That is, because the cooking chambers reach their preheat exit temperatures at the same time, one signal may be given to alert the user that each chamber is preheated. The signal may be, e.g., any audible and/or visual signal that indicates to the user that each cooking chamber is preheated. By way of example, the signal may be a notification displayed on control panel 130 of the appliance, an LED light, a buzzer, and/or any other appropriate visual and/or audible signal.

At step 422, controller 154 executes the sync cooking cycle of each cooking chamber. More particularly, step 418 of initiating a sync cooking cycle for each cooking chamber may comprise initiating one of several predetermined cooking cycles for each cooking chamber based on one or more parameters, such as, e.g., the cook mode and/or cooking temperature selected by the user. That is, one or more sync cooking cycles, specifying, e.g., which heating element or elements to use and the duty cycle of each heating element used, may be established before or during the manufacture of oven appliance 100, and the predetermined cooking cycles may be programmed into, e.g., controller 154. For example, the heating profile for each cooking chamber may be determined before or during the manufacture of oven appliance 100, from which the predetermined cooking cycles are generated for a range of user inputs. Then, at step 418, controller 154 initiates a sync cooking cycle for each cooking chamber that, based on user inputs, controller 154 selects from the predetermined cooking cycles. In this way, the energy input rate for each cooking chamber may be set such that, upon execution of the cooking cycle of each cooking chamber at step 422, the food items in each cooking chamber finish cooking at approximately the same time.

Alternatively or additionally, step 418 of initiating sync cooking cycles may comprise initiating a predetermined cooking cycle for each cooking chamber that adjusts the cooking temperature of each cooking chamber or one of the cooking chambers. That is, in initiating a cooking cycle for each chamber, controller 154 may adjust a target cooking temperature for one or each cooking chamber to ensure the cooking temperature is set in a way that, upon execution of the cooking cycle of each cooking chamber at step 422, the food items in each cooking chamber finish cooking at approximately the same time. Controller 154 may adjust the target cooking temperature based on one or more user inputs, such as, e.g., the cook mode and selected cooking temperature. Other ways of adjusting the cooking cycles of the cooking chambers when operating in the sync mode also may be used to ensure the food items in each cooking chamber finish cooking at substantially the same time when the cooking cycle of each chamber is executed at step 422.

In some embodiments, method 400 also may include step 424 of signaling the user that the food items are cooked, i.e., that the cooking cycle of each cooking chamber is complete. Because method 400 is configured such that the food item or items in each cavity finish cooking at substantially the same time, one signal may be provided to the user to indicate the food items are cooked. The signal may be, e.g., any audible and/or visual signal that indicates to the user that each cooking chamber is preheated. By way of example, the signal may be a notification displayed on control panel 130 of the appliance, an LED light, a buzzer, and/or any other appropriate visual and/or audible signal.

Referring now to FIG. 5, one method for determining whether one cooking chamber is heating faster than the other cooking chamber is illustrated. That is, in some embodiments, step 412 of determining whether one cooking chamber is heating faster than the other cooking chamber may comprise the following steps. After step 410, where controller 154 initiates a preheat cycle for each cooking chamber, at step 502 controller 154 counts time $t_{check}$. When time $t_{check}$ elapses, controller 154 senses the temperature T within each cooking chamber, i.e., controller 154 determines the temperature T within each cooking chamber at time $t_{check}$. For example, using temperature sensor 150 within each cooking chamber, controller 154 senses a temperature $T_1$ within upper cooking chamber 112 and a temperature $T_2$ within lower cooking chamber 114. Controller 154 then compares the temperature T of each cooking chamber to determine if one cooking chamber is heating faster than the other cooking chamber. For example, at step 506, controller 154 determines whether temperature $T_1$ is greater than temperature $T_2$ and, if so, then at step 508 controller 154 adjusts one or more parameters of the preheat cycle of upper cooking chamber 112, as previously described. If temperature $T_1$ is not greater than temperature $T_2$, then at step 510 controller 154 determines whether temperature $T_2$ is greater than temperature $T_1$. If so, then at step 512 controller 154 adjusts one or more parameters of the preheat cycle of lower cooking chamber 114, as previously described. In another exemplary embodiment, controller 154 determines if temperature T1 is greater than temperature T2 by a predetermined amount (e.g., 1, 5, or 10° C.) before proceeding in step 508 to adjust the one or more parameters.

If temperature $T_2$ is not greater than temperature $T_1$, then the method proceeds to step 416, where controller 154 determines whether the temperature within each cooking chamber has reached at least its preheat exit temperature $T_{pre}$, e.g., whether the temperature within upper cooking chamber 112 has reached at least preheat exit temperature $T_{pre1}$ and the temperature within lower cooking chamber 114 has reached at least preheat exit temperature $T_{pre2}$. If the temperature within each cooking chamber has not reached at least its preheat exit temperature $T_{pre}$, e.g., temperature $T_1$ is not at least temperature $T_{pre1}$ and temperature $T_2$ is not at least temperature $T_{pre2}$, then the method returns to step 502 of counting time $t_{check}$. However, if the temperature within each cooking chamber has reached at least its preheat exit temperature $T_{pre}$, the method proceeds to step 418 and proceeds as shown in FIG. 4.

FIG. 6 illustrates another exemplary method for determining whether one cooking chamber is heating faster than the other cooking chamber. That is, in some embodiments, step 412 of determining whether one cooking chamber is heating faster than the other cooking chamber may comprise the following steps. After step 410, where controller 154 initiates a preheat cycle for each cooking chamber, at step 602 controller 154 senses an initial temperature $T_{initial}$ of each cooking chamber and begins counting an elapsed time t for each cooking chamber. For example, using temperature sensor 150 of each cooking chamber, controller 154 senses an initial temperature $T_{initial1}$ of upper cooking chamber 112 and an initial temperature $T_{initial2}$ of lower cooking chamber 114, and controller 154 begins counting an elapsed time $t_1$ for upper chamber 112 and an elapsed time $t_2$ for lower chamber 114. Then, at step 604, controller 154 senses the temperature within one cooking chamber and, at step 606, determines whether the temperature within the cooking chamber has reached at least a checkpoint temperature $T_{check}$. For example, checkpoint temperature $T_{check}$ may be the sum of the initial temperature $T_{initial}$ and an offset temperature $T_{offset}$, such that a checkpoint temperature $T_{check1}$ may be determined for upper cooking chamber 112 and a checkpoint temperature $T_{check2}$ may be determined for lower cooking chamber 114. Thus, at step 604, controller 154 may sense the temperature $T_1$ within upper cooking chamber 112, and at step 606, controller 154 may compare the sensed temperature $T_1$ within upper cooking chamber 112 to checkpoint temperature $T_{check1}$. If temperature $T_1$ within upper cooking chamber 112 has reached at least checkpoint temperature $T_{check1}$, at step 608, controller 154 stops counting time $t_1$. However, if temperature $T_1$ within upper cooking chamber 112 has not reached at least checkpoint temperature $T_{check1}$, the method returns to step 604 and controller 154 continues sensing the temperature $T_1$ within upper cooking chamber 112 and comparing temperature $T_1$ to checkpoint temperature $T_{check1}$.

While controller 154 is performing steps 604, 606, and 608 with respect to upper cooking chamber 112, controller 154 may also perform identical steps with respect to lower cooking chamber 114. That is, controller 154 simultaneously determines at what time t each cooking chamber reaches its checkpoint temperature $T_{check}$. Thus, at step 610, controller 154 senses the temperature within another cooking chamber and, at step 612, determines whether the temperature within the other cooking chamber has reached at least a checkpoint temperature $T_{check}$. For example, at step 610, controller 154 may sense the temperature $T_2$ within lower cooking chamber 114, and at step 612, controller 154 may compare the sensed temperature $T_2$ within lower cooking chamber 114 to checkpoint temperature $T_{check2}$. If temperature $T_2$ within lower cooking chamber 114 has reached at least checkpoint temperature $T_{check2}$, at step 614, controller 154 stops counting time $t_2$. However, if temperature $T_2$ within upper cooking chamber 112 has not reached at least checkpoint temperature $T_{check2}$, the method returns to step 610 and controller 154 continues sensing the temperature $T_2$ within lower cooking chamber 114 and comparing temperature $T_2$ to checkpoint temperature $T_{check2}$. In this way, controller 154 performs steps 604, 606, and 608 simultaneously with steps 610, 612, and 614 to determine the time t at which each cooking chamber reaches its checkpoint temperature $T_{check}$.

Once each time t to reach each checkpoint temperature $T_{check}$ is established, the times t are compared to determine whether one cooking chamber is heating faster than the other cooking chamber. For example, at step 616, controller 154 determines whether time $t_1$ is greater than time $t_2$. If so, then lower cooking chamber 114 is heating faster than upper cooking chamber 112, and at step 618, controller 154 adjusts one or more parameters of the preheat cycle of lower cooking chamber 114, as previously described. If time $t_1$ is not greater than time $t_2$, then at step 620, controller 154 determines whether time $t_2$ is greater than time $t_1$. If so, then upper cooking chamber 112 is heating faster than lower cooking chamber 114, and at step 622, controller 154 adjusts one or more parameters of the preheat cycle of upper cooking chamber 112, as previously described.

If time $t_2$ is not greater than time $t_1$, then the method proceeds to step 416, where controller 154 determines whether the temperature within each cooking chamber has reached at least its preheat exit temperature $T_{pre}$, e.g., whether the temperature within upper cooking chamber 112 has reached at least preheat exit temperature $T_{pre1}$ and the temperature within lower cooking chamber 114 has reached at least preheat exit temperature $T_{pre2}$. If the temperature within each cooking chamber has not reached at least its preheat exit temperature $T_{pre}$, e.g., temperature $T_1$ is not at least temperature $T_{pre1}$ and temperature $T_2$ is not at least temperature $T_{pre2}$, then the method returns to step 602, where controller 154 senses the initial temperature $T_{initial}$ of each cooking chamber and begins counting an elapsed time t for each cooking chamber. However, if the temperature within each cooking chamber has reached at least its preheat exit temperature $T_{pre}$, the method proceeds to step 418 and continues to proceed as shown in FIG. 4.

Thus, as shown in FIGS. 5 and 6, whether one cooking chamber is heating faster during the preheat cycle than another cooking chamber may be determined in several different ways. As illustrated in FIG. 5, in one exemplary embodiment, the temperature of each cooking chamber at a predetermined time may determine whether one cooking chamber is heating faster than the other cooking chamber. That is, if one cooking chamber is at a higher temperature than another cooking chamber at the predetermined time, the chamber at the higher temperature (the hotter chamber) is heating faster than the other cooking chamber. In another exemplary embodiment, as shown in FIG. 6, the time required for each cooking chamber to reach a predetermined temperature may determine whether one cooking chamber is heating faster than the other cooking chamber. That is, if one cooking chamber requires more time to reach the predetermined temperature than another cooking chamber, the chamber that requires more time is heating slower than the other cooking chamber, i.e., the other cooking chamber is heating faster. Other ways of determining whether one cooking chamber is ramping or heating faster than another cooking chamber may be used as well.

As described above, an oven appliance may be configured such that a user may utilize multiple cooking chambers in a synchronization mode, e.g., to cook the same type of food item in each oven cavity. In the synchronization mode, one or more components of the oven appliance, such as a controller, may adjust or select parameters of the preheat and cooking cycles of each cooking chamber such that the chambers exit preheat as close to simultaneously as possible and food items within the chambers finish cooking as close to simultaneously as possible. For example, the controller may compare and adjust the heating rate of each cooking chamber and/or may execute preprogrammed cycles to ensure each cooking chamber completes each cycle at substantially the same time.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A method for operating an oven appliance, the oven appliance having an upper cooking chamber and a lower cooking chamber each configured for receipt of food items for cooking, the method comprising:

ascertaining whether a sync mode of the oven appliance has been selected and, if so, then determining a preheat exit temperature $T_{pre1}$ for the upper cooking chamber and a preheat exit temperature $T_{pre2}$ for the lower cooking chamber;

initiating a preheat cycle for each cooking chamber such that both cooking chambers begin heating at the same time;

determining whether the upper or lower cooking chamber is heating faster than the other cooking chamber and, if so, then adjusting the preheat cycle of the cooking chamber that is heating faster; and determining whether a temperature within the upper cooking chamber has reached at least the preheat exit temperature $T_{pre1}$ and a temperature within the lower cooking chamber has reached at least the preheat exit temperature $T_{pre2}$ and, if so, then initiating a sync cooking cycle for each cooking chamber when the cooking chambers exit the preheat cycle.

2. The method of claim 1, wherein determining whether the upper or lower cooking chamber is heating faster than the other cooking chamber comprises comparing a temperature of the upper cooking chamber at a time $t_{check}$ to a temperature of the lower cooking chamber at the time $t_{check}$.

3. The method of claim 1, wherein determining whether the upper or lower cooking chamber is heating faster than the other cooking chamber comprises comparing a time $t_1$ the upper cooking chamber required to reach at least a temperature $T_{check}$ to a time $t_2$ the lower cooking chamber required to reach at least the temperature $T_{check}$.

4. The method of claim 1, further comprising detecting one or more inputs by a user of the oven appliance prior to ascertaining whether the sync mode has been selected.

5. The method of claim 1, further comprising, when the temperature within the upper cooking chamber has reached at least the preheat exit temperature $T_{pre1}$ and the temperature within the lower cooking chamber has reached at least the preheat exit temperature $T_{pre2}$, signaling to a user of the oven appliance that the preheat cycle of each cooking chamber is complete.

6. The method of claim 1, wherein the preheat cycle for each cooking chamber comprises operating one or more heating elements of each cooking chamber based on one or more inputs by a user of the oven appliance.

7. The method of claim 1, wherein initiating the sync cooking cycle for each cooking chamber comprises initiating a predetermined cooking cycle based on one or more inputs by a user of the oven appliance.

8. The method of claim 1, wherein adjusting the preheat cycle of the cooking chamber that is heating faster comprises adjusting a duty cycle of a heating element of the cooking chamber that is heating faster.

9. The method of claim 1, wherein when, upon determining whether the temperature within the upper cooking chamber has reached at least the preheat exit temperature $T_{pre1}$ and the temperature within the lower cooking chamber has reached at least the preheat exit temperature $T_{pre2}$, the upper and lower cooking chambers have not reached at least their respective preheat exit temperatures, the method returns to determining whether the upper or lower cooking chamber is heating faster than the other cooking chamber.

10. The method of claim 1, wherein when, upon determining whether the upper or lower cooking chamber is heating faster than the other cooking chamber, neither cooking chamber is heating faster than the other cooking chamber, the method proceeds to determining whether the temperature within the upper cooking chamber has reached at least the preheat exit temperature $T_{pre1}$ and the temperature within the lower cooking chamber has reached at least the preheat exit temperature $T_{pre2}$ without adjusting the preheat cycle of either cooking chamber.

11. An oven appliance, comprising:

a cabinet, the cabinet defining an upper cooking chamber and a lower cooking chamber, each of the upper and lower cooking chamber configured for receipt of food items for cooking;

a plurality of upper heating elements, the upper heating elements configured to heat the upper cooking chamber;

a plurality of lower heating elements, the lower heating elements configured to heat the lower cooking chamber; and a controller in operative communication with the upper and lower heating elements, the controller programmed for ascertaining whether a sync mode of the oven appliance has been selected and, if so, then determining a preheat exit temperature $T_{pre1}$ for the upper cooking chamber and a preheat exit temperature $T_{pre2}$ for the lower cooking chamber;

initiating a preheat cycle for each cooking chamber such that both cooking chambers begin heating at the same time;

determining whether the upper or lower cooking chamber is heating faster than the other cooking chamber and, if so, then adjusting the preheat cycle of the cooking chamber that is heating faster; and determining whether a temperature within the upper cooking chamber has reached at least the preheat exit temperature $T_{pre1}$ and a temperature within the lower cooking chamber has reached at least the preheat exit temperature $T_{pre2}$ and, if so, then initiating a sync cooking cycle for each cooking chamber when the cooking chambers exit the preheat cycle.

12. The oven appliance of claim 11, wherein the controller is further programmed for comparing a temperature of the upper cooking chamber at a time $t_{check}$ to a temperature of the lower cooking chamber at the time $t_{check}$ to determine whether the upper or lower cooking chamber is heating faster than the other cooking chamber.

13. The oven appliance of claim 11, wherein the controller is further programmed for comparing a time $t_1$ the upper cooking chamber required to reach at least a temperature $T_{check}$ to a time $t_2$ the lower cooking chamber required to reach at least the temperature $T_{check}$ to determine whether the upper or lower cooking chamber is heating faster than the other cooking chamber.

14. The oven appliance of claim 11, further comprising a sync mode control that is manipulated by a user of the oven appliance to select the sync mode.

15. The oven appliance of claim 11, wherein initiating the sync cooking cycle for each cooking chamber comprises initiating a predetermined cooking cycle based on one or more inputs by a user of the oven appliance.

16. The oven appliance of claim 11, wherein the controller adjusts a duty cycle of one of the plurality of heating elements of the cooking chamber that is heating faster to adjust the preheat cycle of the cooking chamber that is heating faster.

17. The oven appliance of claim 11, wherein the controller is further programmed for signaling to a user of the oven appliance that the preheat cycle of each cooking chamber is complete when the temperature within the upper cooking chamber has reached at least the preheat exit temperature $T_{pre1}$ and the temperature within the lower cooking chamber has reached at least the preheat exit temperature $T_{pre2}$.

18. The oven appliance of claim 11, wherein the controller is further programmed for executing the sync cooking cycle of each cooking chamber after the sync cooking cycle of each cooking chamber is initiated.

19. The oven appliance of claim 18, wherein the controller is further programmed for, upon executing of the sync cooking cycle of each cooking chamber, signaling to a user of the oven appliance that food items placed within each cooking chamber have finished cooking.

20. An oven appliance, comprising:

a cabinet, the cabinet defining an upper cooking chamber and a lower cooking chamber, each of the upper and lower cooking chamber configured for receipt of food items for cooking;

a plurality of upper heating elements, the upper heating elements configured to heat the upper cooking chamber;

a plurality of lower heating elements, the lower heating elements configured to heat the lower cooking chamber; and a controller in operative communication with the upper and lower heating elements, the controller programmed for ascertaining whether a sync mode of the oven appliance has been selected and, if so, then determining a preheat exit temperature $T_{pre1}$ for the upper cooking chamber and a preheat exit temperature $T_{pre2}$ for the lower cooking chamber;

initiating a preheat cycle for each cooking chamber such that both cooking chambers begin heating at the same time;

determining whether the upper or lower cooking chamber is heating faster than the other cooking chamber and, if so, then adjusting the preheat cycle of the cooking chamber that is heating faster such that both cooking chambers exit the preheat cycle at the same time; and initiating a sync cooking cycle for each cooking chamber when the cooking chambers exit the preheat cycle.

* * * * *